United States Patent [19]

Verger et al.

[11] 4,075,588

[45] Feb. 21, 1978

[54] SWITCHING APPARATUS

[75] Inventors: Nathan Verger, Great Neck; Gerhard Schmidt, Rego Park, both of N.Y.

[73] Assignee: Alarm Device Manufacturing, Co., Syossett, N.Y.

[21] Appl. No.: 628,849

[22] Filed: Nov. 5, 1975

Related U.S. Application Data

[63] Continuation of Ser. No. 414,442, Nov. 9, 1973, abandoned, which is a continuation of Ser. No. 285,353, Aug. 31, 1972, abandoned.

[51] Int. Cl.[2] ..... H01H 36/00

[52] U.S. Cl. ..... 335/207

[58] Field of Search ..... 335/207, 206, 205

[56] References Cited

U.S. PATENT DOCUMENTS

| | | | |
|---|---|---|---|
| 3,539,741 | 11/1970 | Voland | 335/207 |
| 3,691,490 | 9/1972 | Ragni | 335/207 |
| 3,940,725 | 2/1976 | Verger et al. | 335/207 |

*Primary Examiner*—Harold Broome

*Attorney, Agent, or Firm*—Sommers & Sommers

[57] ABSTRACT

An apparatus for switching an alarm-signalling device connectable to a protective circuit so as to signal an alarm when a door or the like is displaced from its closed position in a jamb or the like by an intruder, in which the switching apparatus is mounted in the door and jamb or the like. The switching apparatus includes a switch connectable to the protective circuit, mounted in a housing installable so as to be recessed in the jamb, and a metal plate installable so as to be recessed in the side of the door and disposed opposite the switch when the door is closed in the jamb. The switch includes a pair of contacts disposed in one end of the housing, a magnet reciprocally movable in the other end of the housing, and magnetized such that opposite faces thereof define poles of opposite polarity, a hollow metal plate mounted in the housing intermediate the pair of contacts and the magnet, and a connector extending through the hollow metal plate and connecting the magnet to one of the contacts for movement therewith. When the metal plate is positioned opposite the housing, upon closing the door or the like in the jamb or the like, the magnet is attracted towards the metal plate and moves the contact connected thereto so as to compress the contacts in a rolling and wiping action to close the protective circuit. When the door and metal plate mounted therein are displaced from their closed position in the jamb, the magnet is attracted to the hollow metal plate and moves the contact connected thereto so as to open the protective circuit which actuates the alarm-signalling device.

9 Claims, 7 Drawing Figures

SWITCHING APPARATUS

BACKGROUND OF THE INVENTION

This application is a continuation of application Ser. No. 414,442 filed on Nov. 9, 1973, which was a continuation of application Ser. No. 285,353 filed on Aug. 31, 1972 both now abandoned.

This invention relates generally to switching devices, and more specifically to an apparatus for switching an alarm-signalling device connected to a protective circuit so as to signal an alarm upon displacement by an intruder of a door or window or the like from its closed position in a jamb or frame or the like in which the switching apparatus is mounted.

One form of switching apparatus previously used included a switch connectable to a protective circuit and mounted in a housing installable on the outside surface of a jamb or frame or the like, and a magnet mounted in a housing installable on the outside surface of a door or window or the like; the exposed installation of such devices, necessary for proper operation thereof, subjected such devices to being circumvented or disconnected. The switch closing forces generated by such devices were insufficient to prevent open-circuiting of the protective circuit and signalling of false alarms upon movement thereof by extraneous forces acting thereon. Such devices were subject to defeat by insertion of an extraneous magnet between the switch and magnet, and were subject to switch teasing and breakdown by insertion of metal devices between the switch and magnet. The switch surfaces in such devices were subject to corrosion and pitting which generated arcing and interfered with proper switch operation.

SUMMARY OF THE INVENTION

In view of the above, one of the objects of this invention is to provide a switching apparatus installable in a door and jamb or the like so as to be operable while being concealed therein, and operable to generate substantial switch closing and holding force. Another object of this invention is to provide such an apparatus substantially immune to defeat or teasing and breakdown by the use of extraneous devices, and operable to remove corrosion and pitting from switch surfaces.

The above objects and others are provided pursuant to this invention, by an apparatus for switching an alarm-signallling device connectable to a protective circuit so as to signal an alarm when a door or the like is displaced from its closed position in a jamb or the like by an intruder, in which the switching apparatus is mounted in the door and jamb or the like, comprising a switch connectable to the protective circuit and mounted in a housing installable so as to be recessed in the jamb, and a metal plate installable so as to be recessed in the side of the door and disposed opposite the switch when the door is closed in the jamb. The recessed mounting of the switching apparatus and the orientation of the switch and magnet enable the apparatus to be operable while being concealed so as to prevent circumvention or disconnection thereof. The switch includes a pair of contacts disposed in one end of the housing, a magnet reciprocally movable in the other end of the housing, and magnetized such that opposite faces thereof define poles of opposite polarity, a hollow metal plate mounted in the housing intermediate the pair of contacts and the magnet, and a connector extending through the hollow metal plate and connecting the magnet to one of the contacts for movement therewith. When the metal plate is positioned opposite the housing, upon closing the door or the like in the jamb or the like, the magnet is attracted towards the metal plate and moves the contact connected thereinto so as to compress the contacts in a rolling and wiping action to close the protective circuit; when the door and metal plate are displaced from their closed position in the jamb, the magnet is attracted to the hollow metal plate and moves the contact connected thereto so as to open the protective circuit which actuates the alarm-signalling device. The attracting force exerted by the metal plate on the magnet generates substantial closing and holding force on the contacts when the door is closed in the jamb so as to prevent opening of the contacts and signalling of false alarms upon movement of the apparatus by extraneous forces such as wind and vibration action thereon. Such attracting magnetic force extends between the metal plate and the magnet in a narrow beam so as to prevent defeat of the apparatus by the insertion of extraneous magnets or metal devices between the switch and metal plate. The rolling and wiping action of the contacts upon compression thereof removes corrosion and pitting from the contact surfaces and prevents arcing which would otherwise interfere with proper switch operation by signalling false alarms and leading to eventual switch breakdown.

DESCRIPTION OF THE DRAWINGS

This invention is illustrated, by way of example, in the accompanying drawings, wherein.

DESCRIPTION OF THE PREFERRED EMBODIMENTS

Figure 1:
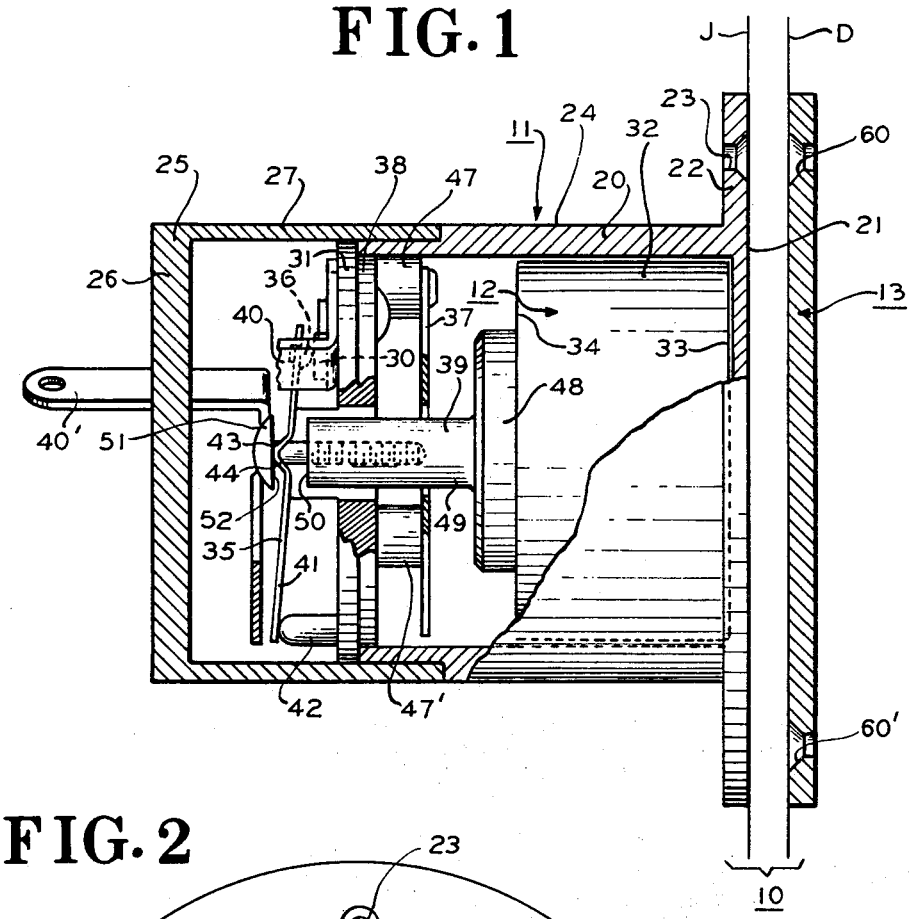
FIG. 1 is a side partly broken partly sectional view of a switching apparatus in accordance with a first embodiment of the invention.
Figure 2:
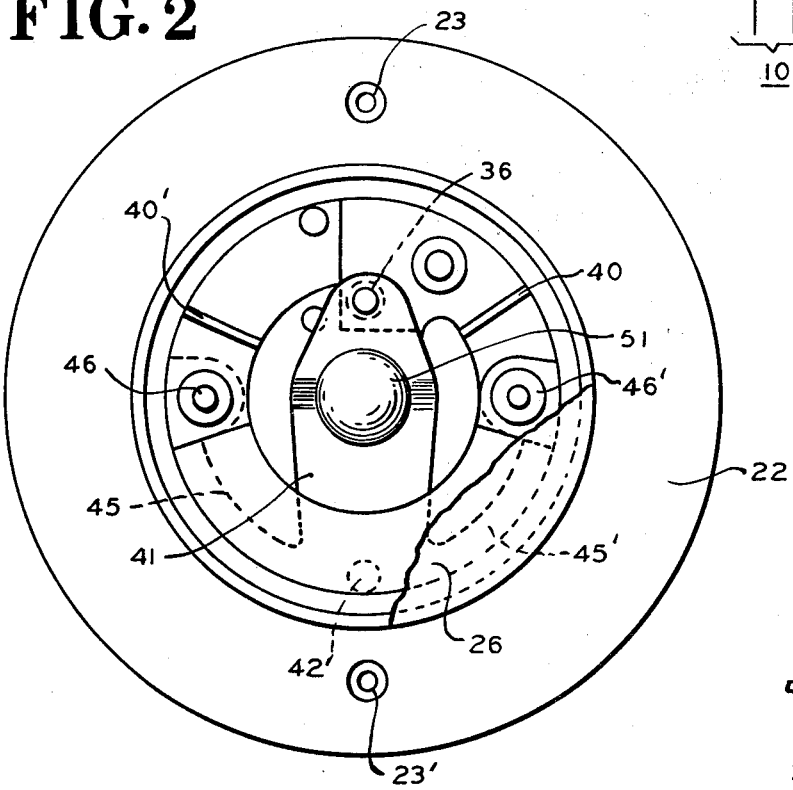
FIG. 2 is an end partly broken plan view of a switch in the first embodiment of the invention.

In one of the preferred embodiments of the invention the switching apparatus 10, illustrated in FIGS. 1, 2, 5 and 6, comprises a housing 11 installable so as to be recessed in a jamb J, a switch 12 mounted in the housing 11 and connectable to a protective circuit to which an alarm-signalling device is also connectable, and a metal plate 13 installable so as to be recessed in the side of a door D and disposed opposite the housing 11 when the door D is closed in the jamb J.

The housing 11 includes a front portion 20 including a front wall 21 which includes a concentric outer portion 22 thereof having openings 23, 23' therein through which fasteners are securable into the jamb J to secure the housing 11 therein, and a cylindrical side wall 24, and a back portion 25, including a back wall 26, and a cylindrical side wall 27 interengageable with the cylindrical side wall 24 of the front portion 20. The switch 12 comprises a contact 30 secured to a plate 31 mounted on the rear portion of the housing front portion side wall 24, a cylindrical magnet 32 reciprocally movable along the inside surface of the housing front portion side wall 24 and magnetized so that opposite faces thereof define poles of opposite polarity, comprising a front pole 33 and a back pole 34, a resilient support arm 35 which extends into the housing 11 from a location intermediate the contact 30 and the housing back portion back wall 26, a contact 36 mounted on the resilient support arm 35 so as to be disposed in alignment with and opposite to the contact 30, a hollow metal plate 37 connected to a plate 38 secured to the plate 31 opposite the back pole 34 of the magnet 32, a connector 39 which extends through the hollow metal plate 37 and which is secured to the magnet back pole 34 at one end thereof and to the resilient support arm 35 at the other end thereof, and terminal posts 40, 40' which are connected to the contacts 30 and 36, and to which the leads from the protective circuit are connectable. The resilient support arm 35 includes a medial portion 41 bearing against post 42 secured to plate 31, having an opening 43 in a central location therein and a ridge portion 44 extending about the opening 43, and a pair of side portions 45, 45' secured to connectors 46, 46' secured to the plate 31. The hollow metal plate 37 is connected to the plate 31 by support posts 47, 47'. The connector 39 includes a spacer portion 48 secured to the back pole 34 of the magnet 32, a neck portion 49 which extends through the hollow metal plate 37 and which includes a bearing surface 50, and a pin portion 51 which extends through the opening 43 in the resilient support arm 35 and which includes a bearing surface 52. the metal plate 13 has openings 60, 60' therein through which fasteners are securable into the side of the door D to secure the metal plate 13 therein.

The housing 11 and metal plate 13 may be installed in the jamb J and in the side of the door D respectively by marking off the location of openings to be formed therein at locations which are opposite each other when the door D is closed in the jamb J, and drilling countersunk holes therein so that the outer surfaces of the front walls of the housing 11 and metal plate 13 will be substantially flush with the outer surfaces of the door D and jamb J respectively when installed therein, then pulling the leads from the protective circuit to which the alarm-signalling device is connectable through the opening drilled in the jamb J and connecting such leads to the terminal posts 40, 40', and then securing fasteners through the openings 23, 23', 50, 50' in the housing front portion concentric outer portion 22 and the metal plate 13 to secure the housing 11 and metal plate 13 in the jamb J and in the side of the door D respectively. The recessed mounting of the housing 11 in the jamb J and of the metal plate 13 in the side of the door D, with the front pole 33 of the magnet 32 facing the metal plate B, and the concealment of the protective circuit leads, enables the switching apparatus 10 to be operable therein while preventing circumvention or disconnection thereof.

Figure 5:
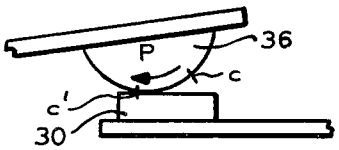
FIG. 5 is a side fragmentary elevational view of contacts in a first position thereof.

When the door D is closed in the jamb J, the metal plate 13 is disposed opposite to and in alignment with the magnet 32, the front pole 33 of the magnet 32 is in contact with the inner surface of the housing front portion wall 21, and the contacts 30 and 36 are closed as illustrated in FIG. 5.

Figure 6:
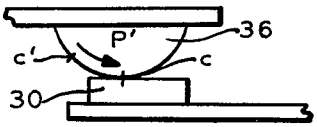
FIG. 6 is a similar view of contacts in a second position thereof.
Figure 3:
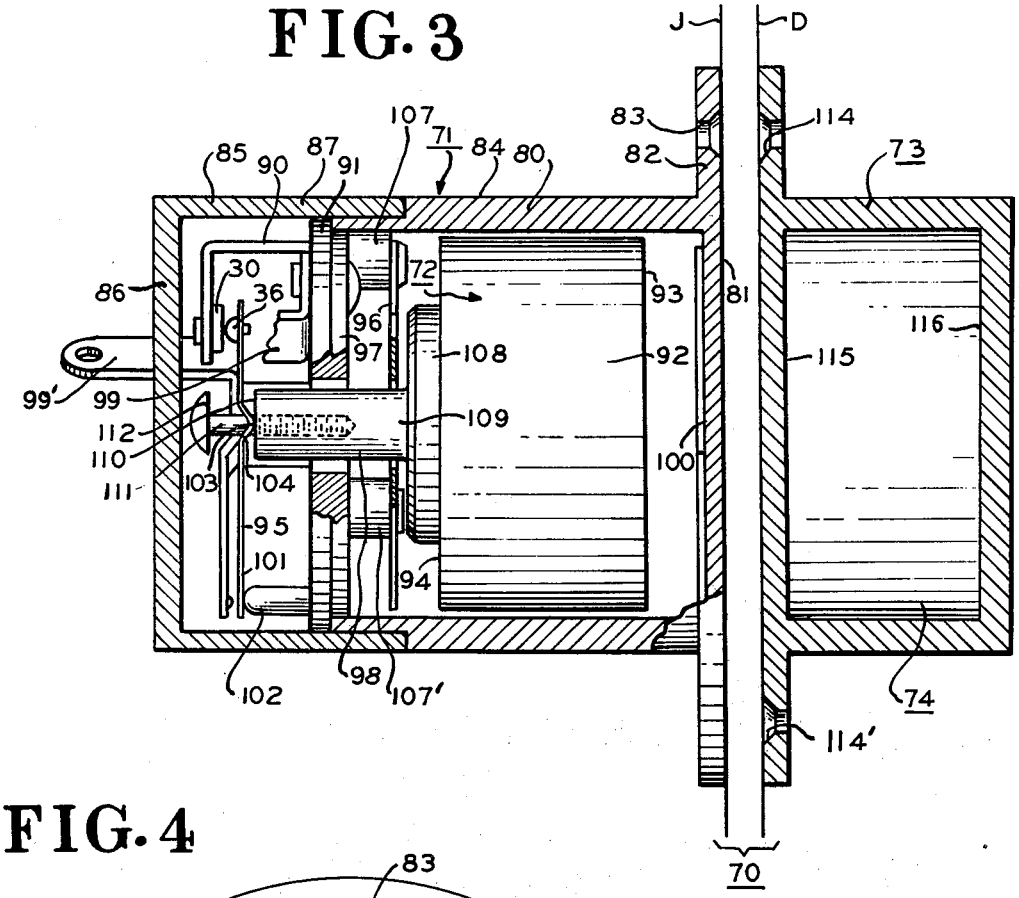
FIG. 3 is a side partly broken partly sectional elevational view of a switching apparatus in accordance with a second embodiment of the invention.
Figure 4:
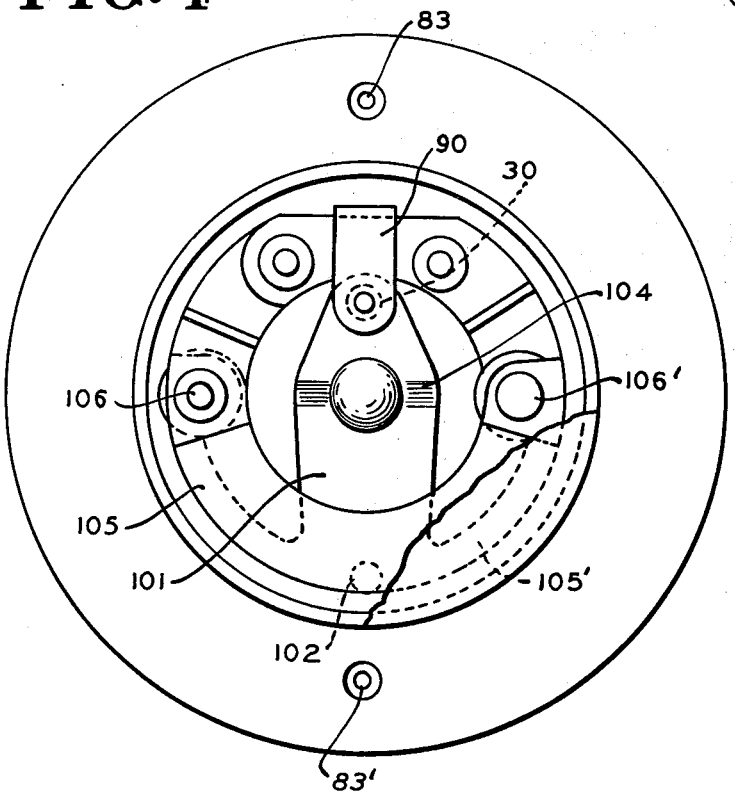
FIG. 4 is an end partly broken plan view of a switch in the second embodiment of the invention.
Figure 7:
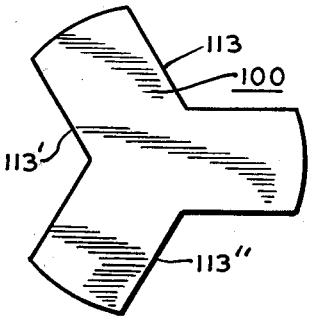
FIG. 7 is an elevational view of a metal plate in the second embodiment of the invention.

When the door D is displaced, as by an intruder, from its closed position in the jamb J, the metal plate 13 moves with the door D away from its position opposite the housing 11, whereupon forces exerted between the magnet 32 and the hollow metal plate 37 initially move the magnet 32 and the connector 39 substantially the distance between the bearing surface 50 of the connector 39 and the medial portion 41 of the resilient support arm 35, which substantially unloads the magnetic forces acting on the magnet 32 while the forces influencing the magnet 32 transfer from the metal plate 13 to the hollow metal plate 37, so that when the bearing surface 50 contacts the medial portion 41 movement of the magnet 32 is not substantially influenced by the metal plate 13; further movement of the magnet 32 and the connector 39 under the influence of the hollow metal plate 37 moves the connector bearing surface 50 so as to bear against the resilient support arm 35, whereupon contact 36 moves from contact point C', illustrated in FIG. 6, through path P' to contact point C, whereupon contact 36 breaks contact with contact 30 in a snap action movement to open the protective circuit, which actuates the alarm-signalling device.

When the alarm-signalling device is reset and the door D is closed in the jamb J, the metal plate 13 moves with the door D to a position opposite to and in alignment with the magnet 32 in housing 11, whereupon forces exerted between the magnet 32 and the metal plate 13 initially move the magnet 32 and the connector 39 substantially the distance between the bearing surface 52 of the connector 39 and the ridge portion 44 of the resilient support arm 35, which substantially unloads the magnetic forces acting on the magnet 32 while the forces influencing the magnet 32 transfer from the hollow metal plate 37 to the metal plate 13 so that when the bearing surface 52 contacts the ridge portion 44, movement of the magnet 32 is not substantially influenced by the hollow metal plate 37; further movement of the magnet 32 and the connector 39 under the influence of the metal plate 13 moves the connector bearing surface 52 so as to bear against the ridge portion 44 of the resilient support arm 35, whereupon contact 36 moves in a snap action movement to contact point C, illustrated in FIG. 5, through path P to contact point C', whereupon contact 36 makes contact with and wipes against the contact 30 to close the protective circuit. Substantial contact closing and holding force is generated by the forces exerted between the magnet 32 and metal plate 13, which prevents opening of the contacts 30 and 36 and signalling of a false alarm upon movement of the switching apparatus 10 by extraneous forces such as wind and vibration action thereon; such forces extend between the magnet 32 and metal plate 13 in a narrow beam, which prevents defeat or teasing or breakdown of the switch 12 by the insertion of extraneous magnets or metal devices between the housing 11 and metal plate 13. The rolling and wiping action of the contacts 30 and 36 upon compression thereof removes corrosion and pitting from the contact surfaces and prevents arcing which would otherwise result in the signalling of false alarms and lead to eventual switch breakdown.

In another preferred embodiment of the invention as illustrated in FIGS. 1, 2, 5 and 6, the element 13 comprises a magnet, the element 32 comprises a cylindrical metallic disc, and the element 37 comprises a hollow magnetic disc, operable substantially as set forth above.

In another preferred embodiment of the invention, the switching apparatus 70, illustrated in FIGS. 3—7, comprise a housing 71 installable so as to be recessed in a jamb J, a switch 72 mounted in the housing 71 and connectable to a protective circuit to which an alarm-signalling device is also connectable, a housing 73 installable so as to be recessed in the side of a door D and disposed opposite the housing 71 when the door D is closed in the jamb J, and a magnet 74 mounted in the housing 73.

The housing 71 includes a front portion 80 including a front wall 81 which includes a concentric outer portion 82 thereof having openings 83, 83' therein through which fasteners are securable into the jamb J to secure the housing 71 therein, and a cylindrical side wall 84, and a back portion 85, including a back wall 86, and a cylindrical side wall 87 interengageable with the cylindrical side wall 84 of the front portion 80. The switch 72 comprises a contact 30 connected by a connector 90 to a plate 91 mounted on the rear portion of the housing front portion side wall 84, a cylindrical magnet 92 reciprocally movable along the inside surface of the housing front portion side wall 84 and magnetized so that opposite faces thereof define poles of opposite polarity, comprising a front pole 93 and a back pole 94, a resilient support arm 95 which extends into the housing 71 from a location intermediate the contact 30 and the plate 91, a contact 36 mounted on the resilient support arm 95 so as to be disposed in alignment with and opposite to the contact 30, a hollow non-metallic plate 96 connected to a plate 97 secured to the plate 91 opposite the back pole 94 of the magnet 92, a connector 98 which extends through the hollow plate 96 and which is secured to the magnet back pole 94 at one end thereof and to the resilient support arm 95 at the other end thereof, terminal posts 99, 99' which are connected to the contacts 30 and 36, and to which the leads from the protective circuit are connectable, and a metal plate 100 secured to the inner surface of the housing front portion front wall 81. The resilient support arm 95 includes a medial portion 101 bearing against post 102 secured to plate 91, having an opening 103 in a central location therein and a ridge portion 104 extending about the opening 103, and a pair of side portions 105, 105' secured to connectors 106, 106' secured to the plate 91. The hollow plate 96 is connected to the plate 91 by support posts 107, 107'. The connector 98 includes a spacer portion 108 secured to the back pole 94 of the magnet 92, a neck portion 109 which extends through the hollow plate 96 and which includes a bearing surface 110, and a pin portion 111 which extends through the opening 103 in the resilient support arm 95 and which includes a bearing surface 112. The metal plate 100 is generally Y-shaped and has cutout portions 113, 113', 113" therein. The housing 73 has openings 114, 114' therein through which fasteners are securable into the side of the door D to secure the housing 73 therein. The magnet 74 is magnetizied so that opposite faces thereof define poles of opposite polarity, comprising a front pole 115 and back pole 116. The polarity of the front pole 115 of the magnet 74 is the same as the polarity of the front pole 93 of the magnet 92 disposed opposite thereto when the door D is closed in the jamb J.

The housings 71 and 73 may be installed in the jamb J and in the side of the door D respectively by marking off the location of openings to be formed therein at locations which are opposite each other when the door D is closed in the jamb J, and drilling countersunk holes therein so that the outer surfaces of the front walls of the housings 71 and 73 will be substantially flush with the outer surfaces of the door D and jamb J respectively when installed therein, then pulling the leads from the protective circuit to which the alarm-signalling device is connectable through the opening drilled in the jamb J and connecting such leads to the terminal posts 99, 99', and then securing fasteners through the openings 83, 83', 114, 114' in the housing front portion concentric outer portion 82 and the housing 73 to secure the housings 71 and 73 in the jamb J and in the side of the door D respectively. The recessed mounting of the housing 71 in the jamb J and of the housing 73 in the side of the door D, with the front pole 93 of the magnet 92 facing the front pole 93 of the magnet 92 facing the front pole 115 of the magnet 74, and the concealment of the protective circuit leads, enables the switching apparatus 70 to be operable therein while preventing circumvention or disconnection thereof.

When the door is closed in the jamb J, the housing 73, and magnet 74 therein, are disposed opposite to and in alignment with the magnet 92, the back pole 94 of the magnet 92 is in contact with the hollow plate 96, and the contacts 30 and 36 are closed as illustrated in FIG. 5.

When the door D is displaced, as by an intruder, from its closed position in the jamb J, the housing 73, and magnet 74 therein, move with the door away from its position opposite the housing 71, whereupon forces exerted between the magnet 92 and the metal plate 100 initially move the magnet 92 and the connector 98 substantially the distance between the bearing surface 110 of the connector 98 and the medial portion 101 of the resilient support arm 95, which substantially unloads the magnetic forces acting on the magnet 92 while the forces influencing the magnet 92 transfer from the magnet 74 to the metal plate 100, so that when the bearing surface 110 contacts the medial portion 101 movement of the magnet 92 is not substantially influenced by the magnet 74; further movement of the magnet 92 and the connector 98 under the influence of the metal plate 100 moves the connector bearing surface 110 so as to bear against the resilient support arm 95 whereupon contact 36 moves from contact point C', illustrated in FIG. 6, through path P' to contact point C, whereupon contact 36 breaks contact with contact 30 in a snap action movement to open the protective circuit, which actuates the alarm-signalling device.

When the alarm-signalling device is reset and the door D is closed in the jamb J, the housing 73, and magnet 74 therein, moves with the door D to a position opposite to and in alignment with the magnet 92 in housing 71, whereupon forces exerted between the magnet 92 and the magnet 74 initially move the magnet 92 and the connector 98 substantially the distance between the bearing surface 112 of the connector 98 and the ridge portion 104 of the resilient support arm 95, which substantially unloads the magnetic forces acting on the magnet 92 while the forces influencing the magnet 92 transfer from the metal plate 100 to the magnet 74 so that when the bearing surface 112 contacts the ridge portion 104, movement of the magnet 92 is not substantially influenced by the metal plate 100; further movement of the magnet 92 and the connector 98 under the influence of the magnet 74 moves the connector bearing surface 112 so as to bear against the ridge portion 104 of the resilient support arm 95, whereupon contact 36 moves in a snap action movement to contact point C, illustrated in FIG. 5, through path P to contact point C', whereupon contact 36 makes contact with and wipes against the contact 30 to close the protective circuit. Substantial contact closing and holding force is generated by the forces exerted between the magnet 92 and magnet 74, which prevents opening of the contacts 30 and 36 and signalling of a false alarm upon movement of the switching apparatus 70 by extraneous forces such as wind and vibration acting thereon; such forces extend between the magnet 92 and magnet 74 in a narrow beam, which prevents defeat or teasing or breakdown of the switch 72 by the insertion of extraneous magnets or metal devices between the housing 71 and the housing 73. The rolling and wiping action of the contacts 30 and 36 upon compression thereof removes corrosion and pitting from the contact surfaces and prevents arcing which would otherwise result in the signalling of false alarms and lead to eventual switch breakdown.

In view of the above, it will be understood that while this invention has been set forth in terms of specific embodiments thereof, variations therein may be made by those skilled in the art which variations are nevertheless within the scope and spirit of this invention. This invention, therefor, is to be broadly construed within the scope and spirit of the following claims.

We claim:

1. An apparatus for making and breaking connections in an electrical circuit, comprising:

a. a first contact;

b. a second contact;

c. means for positioning the second contact opposite the first contact;

d. a magnet which is magnetized such that opposite faces thereof define poles of opposite polarity;

e. means for connecting the magnet to the second contact positioning means comprising a connector secured to the magnet at the end thereof of the first pole and the resilient support arm at the other end thereof, f. means for moving the magnet and the second contact to a position where the second contact breaks contact with the first contact comprising a metal plate positionable opposite a first pole of the magnet;

g. means for moving the magnet and the second contact to a position where the second contact makes contact with the first contact comprising a further metal plate positionable opposite a second pole of the magnet; and h. a housing, in which the second contact positioning means comprises a resilient support arm extendable into the housing at a location therein adjacent the first contact, and in which the magnet is reciprocally movable in the housing, in which the first contact is mounted in one end of the housing, and in which the metal plate positionable opposite a first pole of the magnet is hollow, is mounted in the housing intermediate the first and second contacts and the magnet, and through which the connector extends.

2. A switching apparatus as recited in claim 1, in which the connector includes a spacing collar secured at one end thereof to the one end of the magnet.

3. A switching apparatus as recited in claim 1, in which the resilient support arm has an aperture in a central location therein through which the connector extends, and a ridge portion extending about the central aperture, and in which the connector includes a bearing surface for bearing against the ridge portion.

4. A switching apparatus as recited in claim 3, in which the connector further includes a second bearing surface for bearing against the resilient support arm.

5. An apparatus for making and breaking connections in an electrical circuit, comprising:

a. a first contact;

b. a second contact;

c. means for positioning the second contact opposite the first contact;

d. a magnet which is magnetized such that opposite faces thereof define poles of opposite polarity;

e. means for connecting the magnet to the second contact positioning means comprising a connector secured to one end of the magnet at the end thereof of the first pole and the resilient support arm at the other end thereof f. means for moving the magnet and the second contact to a position where the second contact breaks contact with the first contact comprising a metal plate positionable opposite a second pole of the magnet;

g. means for moving the magnet and the second contact to a position where the second contact makes contact with the first contact, comprising a further magnet, magnetized such that opposite poles thereof define poles of opposite polarity, positionable opposite a second pole of the magnet, in which the pole of the further magnet which faces the second pole of the magnet is of opposite polarity thereto; and h. a housing, in which the second contact positioning means comprises a resilient support arm extendable into the housing at a location therein adjacent the first contact, and in which the magnet is reciprocally movable in the housing, in which the first contact is mounted in one end of the housing, and in which the metal plate is mounted in the housing opposite the second pole end of the magnet.

6. A switching apparatus as recited in claim 5, in which the connector includes a spacer portion secured at one end thereof to one end of the magnet.

7. A switching apparatus as recited in claim 5, in which the resilient support arm has an aperture in a central location therein through which the connector extends and a ridge portion extending about the central aperture, and in which the connector includes a bearing surface for bearing against the ridge portion.

8. A switching apparatus as recited in claim 5, further comprising a hollow non-metallic plate mounted in the housing intermediate the first and second contacts and the magnet, through which the connector extends.

9. A switching apparatus as recited in claim 7, in which the connector further includes a second bearing surface for bearing against the resilient support arm.

* * * * *